US009150392B2

(12) United States Patent
Skyba

(10) Patent No.: US 9,150,392 B2
(45) Date of Patent: Oct. 6, 2015

(54) WINCH

(71) Applicant: Helmut K. Skyba, Wild Rose, WI (US)

(72) Inventor: Helmut K. Skyba, Wild Rose, WI (US)

( * ) Notice: Subject to any disclaimer, the term of this patent is extended or adjusted under 35 U.S.C. 154(b) by 0 days.

(21) Appl. No.: 13/790,698

(22) Filed: Mar. 8, 2013

(65) Prior Publication Data

US 2013/0240810 A1 Sep. 19, 2013

Related U.S. Application Data

(60) Provisional application No. 61/611,290, filed on Mar. 15, 2012.

(51) Int. Cl.
*B66D 1/74* (2006.01)
*B66D 1/06* (2006.01)

(52) U.S. Cl.
CPC ..... *B66D 1/7415* (2013.01); *B66D 1/06* (2013.01); *B66D 1/7452* (2013.01)

(58) Field of Classification Search
USPC ..... 254/333, 371, 372, 374, 384, 391, 402, 254/403, 405, 406, 408, 411
See application file for complete search history.

(56) References Cited

U.S. PATENT DOCUMENTS 5,368,281 A 11/1994 Skyba
5,722,640 A 3/1998 Skyba
6,149,133 A 11/2000 Skyba

*Primary Examiner* — Emmanuel M Marcelo
*Assistant Examiner* — Angela Caligiuri
(74) *Attorney, Agent, or Firm* — Allan O. Maki

(57) ABSTRACT

A winch wherein a rope or cable is self-feeding onto a sheave by a spring that is biased so as to push a rope into contact with a grooved outer surface of the sheave. One end of the spring is pivotally supported on a frame that supports the sheave for rotation about its central axis, while the opposite end of the spring is freely flexible. A supporting block is provided for the free end of the spring to support and minimize or prevent damage to the spring. The block has an angled surface for urging the rope away from the sheave, thus, together with a stripper member, assisting removal of the rope from the sheave at a point at which the rope exits the sheave.

5 Claims, 4 Drawing Sheets

13
10
50
57
58
52
55
12
14
16
11
38
15
48
16
21
28

30
57
56
58
10
16
50
16
52
13
55
14
18

15
48
17
11

WINCH

CROSS REFERENCE TO RELATED APPLICATIONS

This application claims priority to U.S. provisional application Ser. No. 61/611,290 entitled, "Improved Winch," filed Mar. 15, 2012.

BACKGROUND OF THE INVENTION

This application provides improvements of the devices described and claimed in my earlier applications: Ser. No. 382, filed Jan. 4, 1993, now U.S. Pat. No. 5,368,281 issued Nov. 29, 1994; Ser. No. 719636, filed Sep. 25, 1996, now U.S. Pat. No. 5,722,640 issued Mar. 3, 1998; and Ser. No. 974177 filed Nov. 19, 1997, now U.S. Pat. No. 6,149,133 issued Nov. 21, 2000. The disclosure of said patents is incorporated herein by reference.

The present invention to an improved winch that incorporates a sheave, wherein a rope is pulled under tension by either manual or power-driven rotational forces applied to the sheave. This invention relates to pulleys for tightening and tensioning ropes or cords having a ratchet mechanism to permit retaining the same under tension, and more particularly, to such a mechanism which employs the improved sheave to secure a cord or rope which is reeved thereon. The improved winch has particular applicability to boat trailer winches where a cable or rope used to secure a watercraft for transportation and to launch the craft for use in water.

SUMMARY OF THE INVENTION

The winches of the invention are primarily used in connection with trailers for launching and reloading watercraft. Briefly summarized, as in the case of my earlier mentioned devices, the invention provides a ratchet-type tensioning mechanism for a rope or cord having a rotatable sheave with faces having radially extending serrations. A releasable ratchet mechanism permits rotation of the sheave in one direction but not the other. A plurality of serrations having alternating primary and secondary ridges and opposed valleys circumscribes the sheave, each of which has a generally radially extending portion extending outwardly from the base of the sheave, the ridges being positioned at regular intervals around the circumference of the sheave and being located so that a ridge on one face of the sheave faces a secondary ridge in a valley on the opposite face of the sheave. The housing within which the sheave is fitted includes a curved surface that guides the rope into contact with the sheave especially adjacent to the opening which forms the point of entry of the rope into the sheave. The rope exiting side of the housing is provided with an opening to permit access to the sheave. As in the case of my previously disclosed winches, the rope or cable is not wound around a drum, but rather is accumulated loosely either on the trailer or on the watercraft when the watercraft is in use.

While my previous devices, referred to above, have proved workable, the feeding of a rope onto the sheave has often proved troublesome in that manual assistance may be necessary, and even stripping a rope from the sheave can be problematic.

The improvements provided by this invention relate to a sheave assembly wherein the rope or cable is self-feeding onto the sheave by virtue of a spring located adjacent to the sheave that is biased so as to push a rope into contact with the grooved surface of the sheave. One end of the spring is pivotally supported on the frame that supports the sheave for rotation about its central axis, while the opposite end is freely flexible. In accordance with an additional feature, a supporting block is provided at the free end of the spring to support and minimize or prevent damage to the spring. This feature is preferably in the form of a block for supporting the spring that has an angled surface for urging the rope away from the sheave, thus, together with a stripper member, assisting removal of the rope from the sheave at a selected rotational location, preferably near the point at which the rope exits the sheave.

BRIEF DESCRIPTION OF THE DRAWINGS

Various other aspects and advantages of the invention will become apparent in connection with the accompanying drawings wherein.

DETAILED DESCRIPTION

Figure 1:
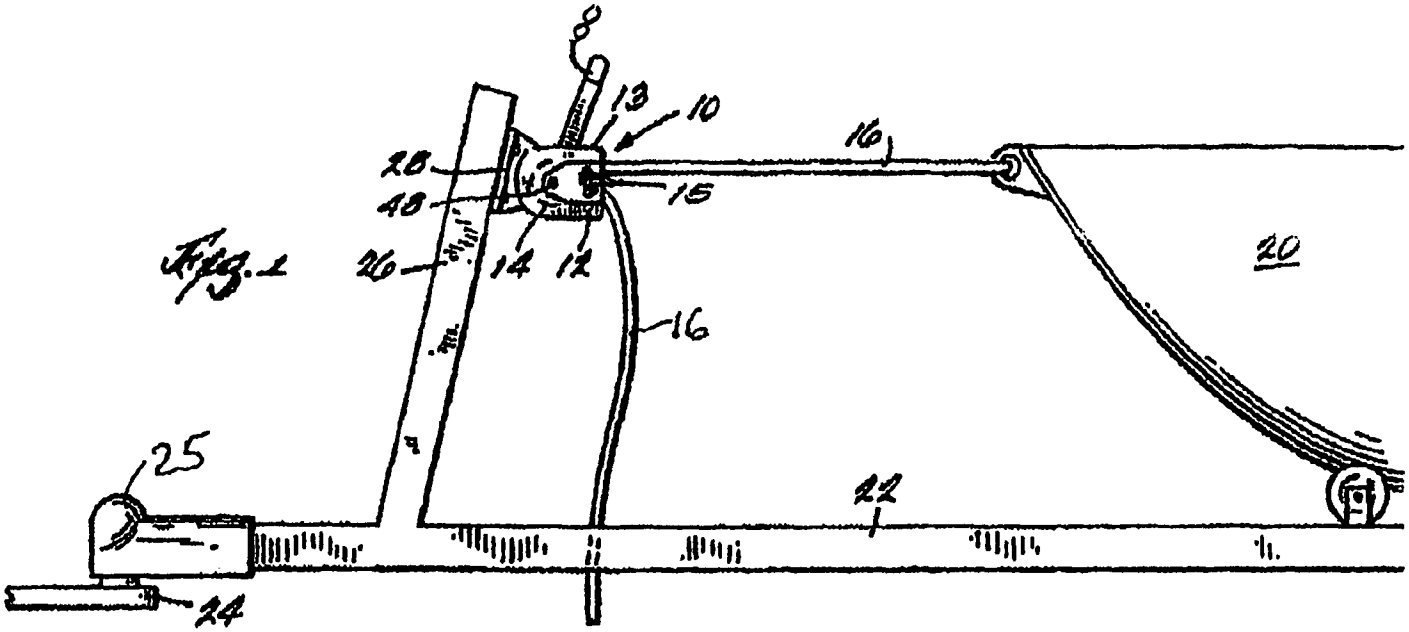
FIG. 1 is a side view of an embodiment of a rope tightening device of this invention attached to a boat trailer tow bar with a rope attached at one end to the boat and to a winch of the present invention.
Figure 2:
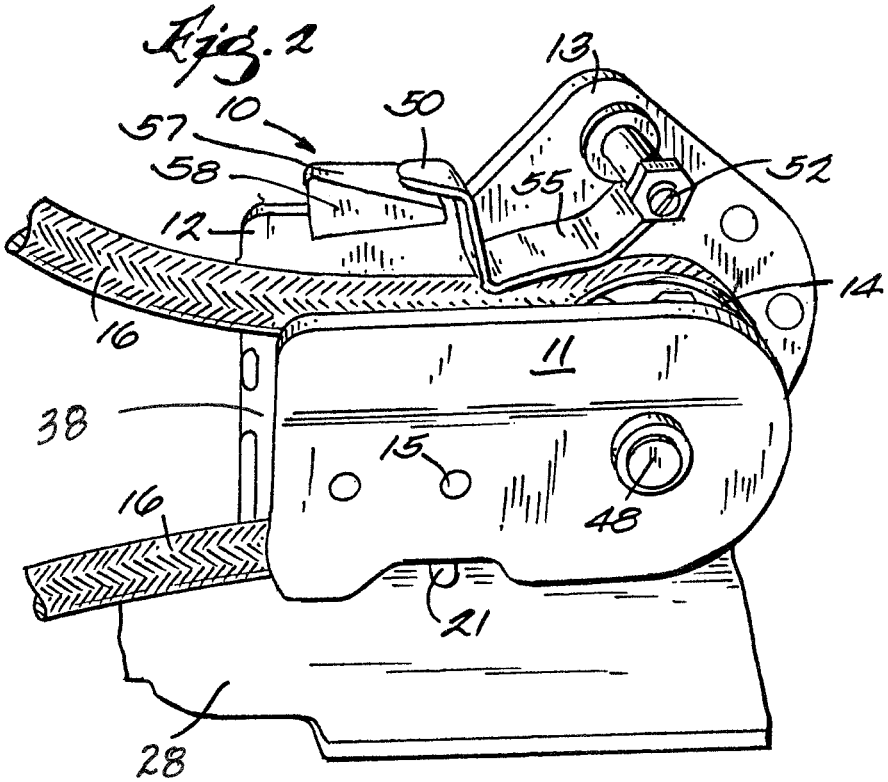
FIG. 2 is a perspective view of the winch shown in FIG. 1 with the rope threaded in an opposite rotational direction from that shown in FIG. 1.

Referring more specifically to the drawings, preferred embodiment of winch 10, intended to be tightened by a hand crank 18, is shown in FIG. 1. Device 10 includes a housing 12 formed from divisible halves 11 and 13 which are attached together as seen in FIG. 2 by conventional mechanical fasteners such as threaded bolts 15. Rotatably held within housing 12 is a sheave 14. Sheave 14, for ease of manufacture, is formed from halves 17 and 18. Halves 17 and 18 may be threaded together as shown in my earlier mentioned patents. Alternatively, each half can be threaded onto a threaded shaft 48 as shown.

The winch 10 can be attached to a suitable surface on a trailer 22, for example, a vertical member 26 or alternatively on a horizontal member. In FIG. 1 a bracket 28 is used for that purpose. Boat 20 is loaded on the trailer in conventional fashion and connected to a ball hitch 24 of a towing motor vehicle by means of a clamp member 25 as is also conventional. The inner face of each half of sheave 14 is provided with alternating primary projections and valleys, described in greater detail in my '640 and '133 patents. Secondary ridges or projections in each of the valleys, as also previously described, with the primary projections on one half of the sheave aligned with secondary projections opposed valleys on the other half to thereby form a slip resistant tortuous path for engagement of a rope or cord.

Figure 3:
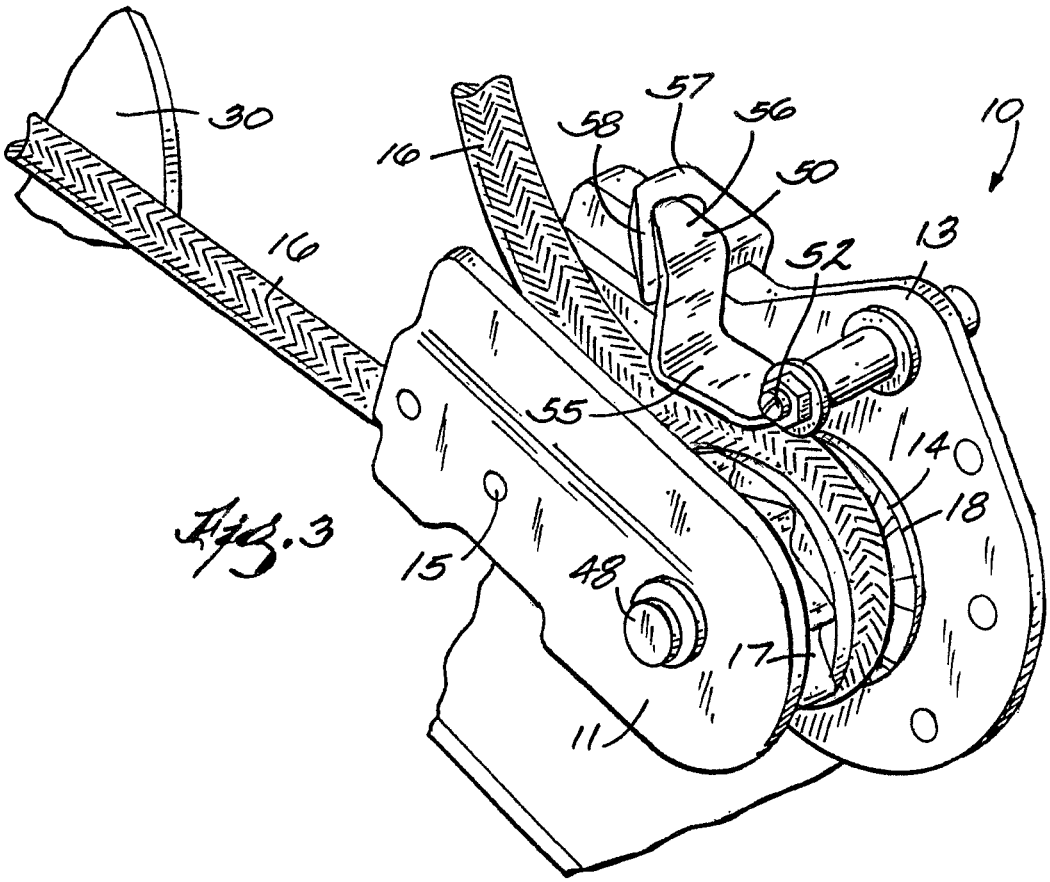
FIG. 3 is a perspective view of the winch of FIG. 2 shown from a higher elevation to further illustrate the spring and supporting block in greater detail.
Figure 5:
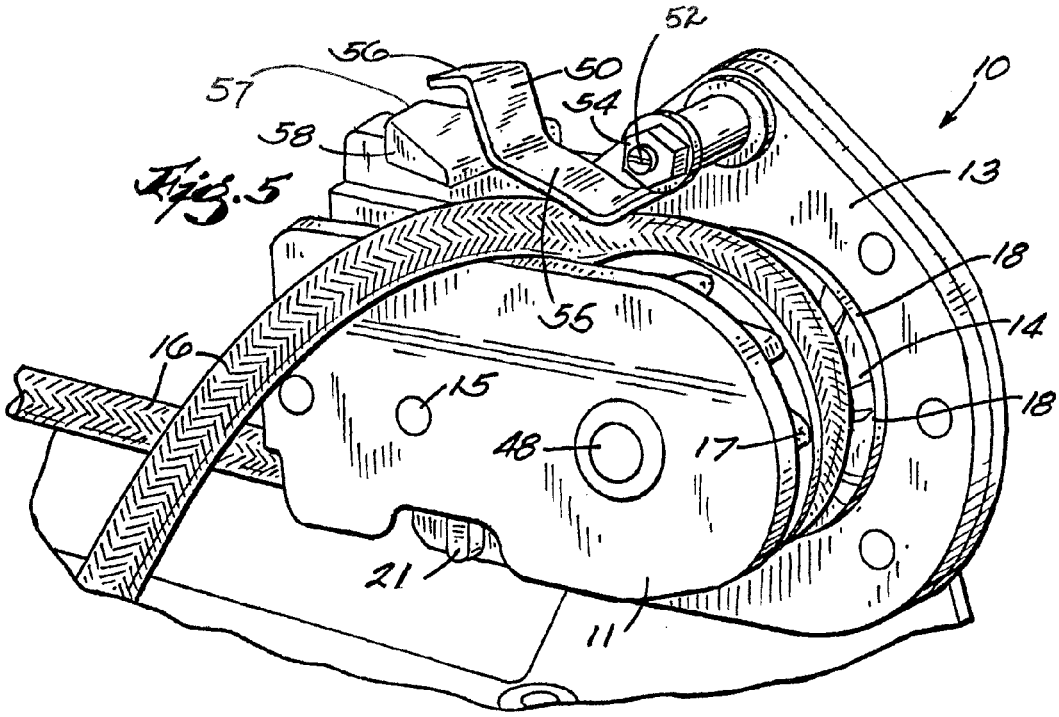
FIG. 5 is a perspective view of a winch of FIG. 2.

While FIG. 1 shows the rope 16 passing onto the top of sheave 14, the rope can optionally be fed onto the sheave 14 in the reverse direction as shown in FIGS. 2-3 and 5.

A central hub surface 42 is located at the central part of the sheave 14. A series of ratchet teeth 23 may be provided on one or both of the sheave halves 11 and 13 in order to provide a capability of one way ratchet advancement of the rope 16. Note, also as in the case of my earlier mentioned devices that the inner sheave surfaces converge arcuately toward the center of the sheave. The primary projections and the secondary projections as well as the valleys within which the secondary projections are located, all also converge generally, in angled fashion toward the central hub surface. Thus, a highly effective but non-destructive wedging action on the rope is provided.

Further details of the assembly of a ratchet mechanism are set forth in detail in my above-mentioned U.S. Pat. No. 5,368,281 the entire text of which is also incorporated herein by reference. Housing 12 forms a slot or chamber within which the sheave 14 can rotate without necessarily being mounted on an axle connected to the chamber. If desired, however, the housing 12 could be designed with appropriate apertures or sockets so that a central axle 48 fitted through a central opening could be used. Alternatively, an axle 48 may be formed integrally with one or both housing halves 11 and 13.

Opening 38 is of a restricted width such that the rope 16 is prevented from passing around the outside of the sheave 14 thereby preventing wedging of the rope between sheave 14 and housing 12. The opening 38 also guides the rope 16 around sheave 14 to ensure maximum contact thereof with the sheave 14.

Figure 4:
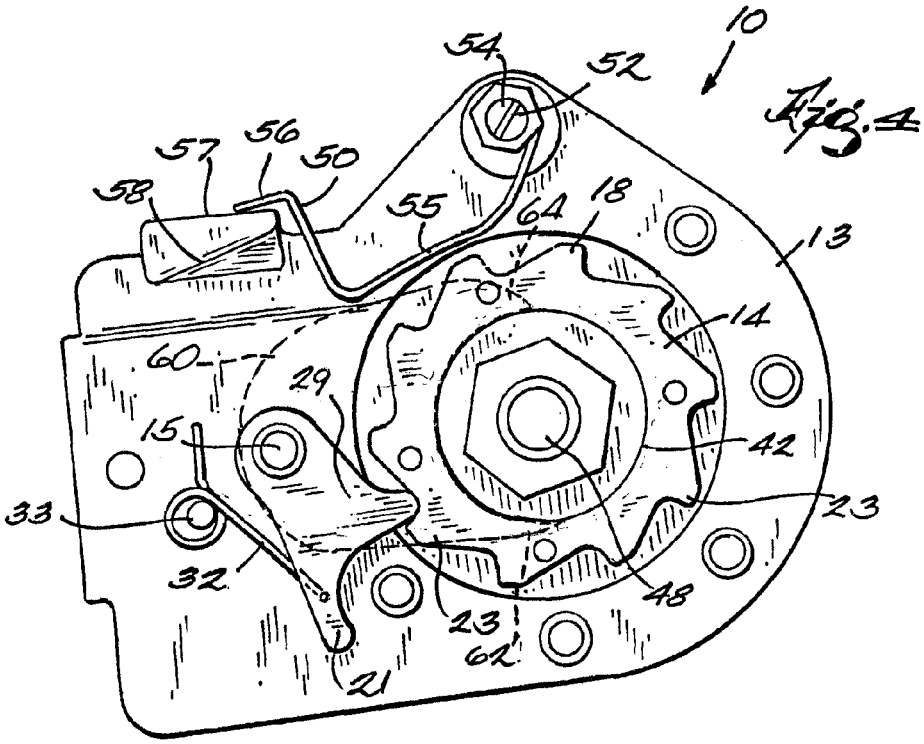
FIG. 4 is a side view of the interior of the winch of FIG. 2 with one half of the housing and sheave removed to expose the interior.

The device is also provided with a ratchet mechanism 21 which is spring loaded by spring 32 mounted on a pin 33 to engage teeth 23 on a sprocket formed integrally with half 18 of the sheave 14. Pawl 29 of ratchet mechanism 21 is urged by spring 32 into the spaces between the teeth 23 of the sheave. As seen in FIGS. 4 and 5, a rope 16 reeved on sheave 14 is permitted to move only in a counterclockwise direction when pawl 29 engages sprocket 23. However, when the ratchet mechanism 21 is pivoted to an open position against spring 32, sheave 14 is also permitted to rotate in the clockwise direction thereby permitting loosening of rope 16.

It has been found that angling of projections of the sheave halves 17 and 18, as shown in my above-mentioned earlier issued patents, assists in aggressive engagement of rope 16 to feed the same readily into contact with the sheave 14 when an end thereof is presented thereto as the sheave 14 is rotated. However, the rope 16 can nonetheless readily be loosened so the same can be removed without binding in the sheave 14. Smooth annular hub surface 42 also assists in ready release of rope 16 especially in the case of larger diameter ropes. A stripper element 60, as shown in my '281 patent, can optionally be used to assist in removal of the rope 16 from sheave 14, if needed. See FIGS. 6*a*-6*c*. In FIG. 4, the stripper element 60, shown by phantom lines and also shown in FIG. 6, has a curved surface 61 adapted to engage the exterior of hub 42. Thus the stripper has been found to support the center of the sheave against forces applied against it by rope 16.

In accordance with the present invention a sheave assembly is provided for a winch wherein the rope or cable 16 is self-feeding onto the sheave 14 by virtue of a spring 50 located adjacent to the sheave 14 that is biased so as to push a rope 16 into contact with the grooved surface of the sheave 14. One end 52 of the spring 50 is affixed so as to be pivotally supported on housing half 13 that supports the sheave 14 for rotation about its central axis 48, while the opposite end 56 is freely flexible. The fixed end 52 of the spring 50 is preferably flattened and a protruding member in the form of a slotted bolt 54, affixed to the housing half 13 has a slot therethrough dimensioned to receive and fix the flattened end 52, or other mechanical means may be used to fix and limit movement of the flattened spring end 52.

In accordance with an additional feature, a supporting block 57 is provided for limiting movement of the free end 56 of the spring 50 to support and minimize or prevent damage to the spring 50. This feature is preferably in the form of block 57. Block 57 has an angled edge 58 that assists in removal of rope 16 from sheave 14. The spring 50 has a central portion 55 that provides an effective cam surface for urging the rope into contact with the sheave. The block 57, together with the optional stripper member 60, assists in removal of the rope 16 from the sheave 14 at a selected rotational location, near the point at which the rope 16 exits the sheave 14. Block 57 may be attached to housing half 13 or attached by means of a screw instead of being integral with block 57 (not shown).

Figure 6A:
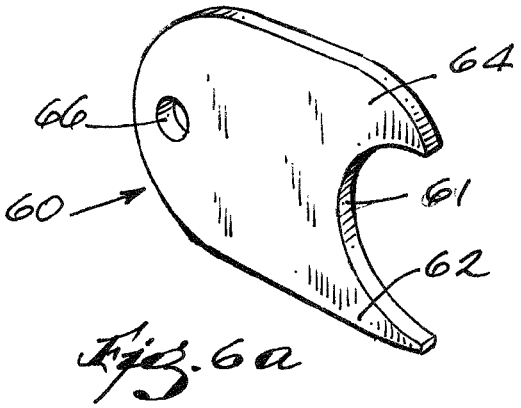
FIGS. 6*a*, 6*b* and 6*c* are perspective, edge and top views of a stripper element of this invention, respectively.
Figure 6B:
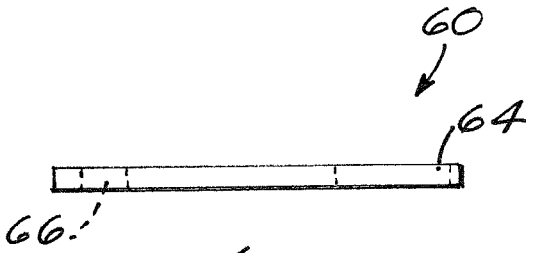
Figure 6C:
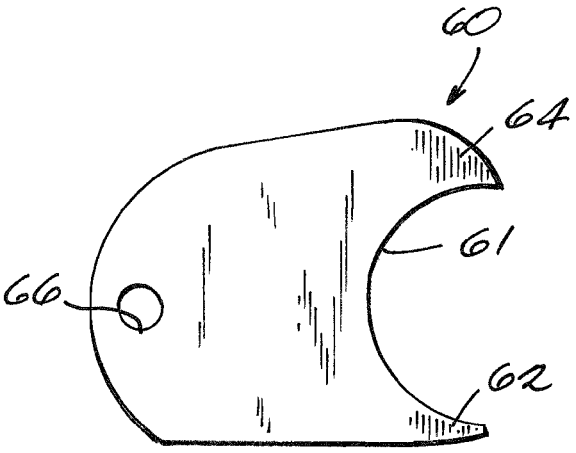

As shown in FIGS. 6*a*, 6*b* and 6*c*, the invention also provides a novel stripper element 60. At the base of the sheave 14 the stripper 60 has a first flattened side 62 which is positioned over central hub surface 42 at a location where the rope enters the sheave 14 as the sheave is rotated. A second, enlarged side 64 is positioned at a location where the rope 16 exits the sheave 14 as the sheave is rotated. Thus the rope 16 readily is received onto the hub 42 of the sheave at the rope 16 entry side and is subsequently loosened and readily expelled from the rotating sheave 14 at the exit side. Opening 66 is provided in order for the stripper element 60 to be attached to the housing 12 by means of bolt 15 or a similar mechanical fastener.

While FIG. 1 shows the rope 16 passing onto the top of sheave 14, as seen in FIGS. 2-3 and 5, the rope can optionally be fed onto the sheave 14 in the reverse direction. An optional intermediate support member 30 can be provided. This can be in the form of a roller or pulley an serves to prevent rope 16 from falling to the ground or snagging any protruding materials that could be encountered in towing of the trailer.

While the invention has been described and illustrated in detail, it is to be understood that various modifications may be made within the spirit of the invention. Thus the scope thereof is limited only by the terms of the following claims and equivalents thereof.

What is claimed is:

1. A winch comprising:

a rotatable sheave mounted for rotation and means for application of rotational forces thereto, said sheave having:

a base;

two opposed faces with a plurality of generally radially extending alternating primary ridges and valleys circumscribing each of said two opposed faces of said sheave, each of said primary ridges extending outwardly from the base of said sheave in a curvilinear direction curving toward a rotational direction toward which a rope or cord reeved on said sheave is advanced by rotation of said sheave, said primary ridges being positioned at intervals around the circumference of said sheave, said primary ridges projecting a first height above the surface of said valleys, a generally radially extending secondary ridge projecting from the center of the surface of each of said valleys, each of said secondary ridges having a second height that is smaller than said first height, a housing within which said sheave is rotatably mounted, said housing being open for insertion and removal of the rope or cord around said sheave, and, a flattened spring having a lower side that forms a guiding cam surface adjacent to the outer perimeter of said sheave, said spring having a first end pivotally mounted to a slotted shaft affixed to said housing, said spring, when pivoted away from said sheave, allowing insertion and removal of the rope or cord from around said sheave, and when pivoted toward the base of the sheave, maintains the rope or cord in contact with the sheave, and wherein a second end of said spring opposite to said pivotal connection is supported on a block which limits movement thereof toward said sheave, and said block having an angled edge for removal of said rope or cord from said sheave.

2. The winch according to claim 1, wherein said block is formed integrally with said housing.

3. The winch according to claim 1, wherein said block is attached to said housing by a mechanical fastener.

4. The winch according to claim 1, wherein said block is attached to said housing by a mechanical fastener.

5. The winch according to claim 1, wherein said slotted shaft is dimensioned to receive said flattened spring, thereby limiting movement of said first end of said spring.

* * * * *